US007501569B2

(12) United States Patent
Hotta

(10) Patent No.: US 7,501,569 B2
(45) Date of Patent: Mar. 10, 2009

(54) ELECTRONIC MUSICAL INSTRUMENT SYSTEM AND PROGRAM THEREOF

(75) Inventor: Harumichi Hotta, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 11/805,470

(22) Filed: May 22, 2007

(65) Prior Publication Data

US 2007/0272073 A1 Nov. 29, 2007

(30) Foreign Application Priority Data

May 23, 2006 (JP) ..... 2006-142533

(51) Int. Cl.
*G10H 1/00* (2006.01)
*G10H 1/18* (2006.01)

(52) U.S. Cl. ..... 84/615; 84/600; 84/622; 84/625; 84/634; 84/653; 84/659; 84/660; 84/666

(58) Field of Classification Search ..... None
See application file for complete search history.

(56) References Cited

U.S. PATENT DOCUMENTS 6,353,169 B1 * 3/2002 Juszkiewicz et al. ..... 84/600
2003/0094092 A1 * 5/2003 Brinkman et al. ..... 84/609
2004/0055444 A1 * 3/2004 Ishii et al. ..... 84/604
2006/0054004 A1 3/2006 Funaki
2006/0236850 A1 * 10/2006 Shaffer ..... 84/724

FOREIGN PATENT DOCUMENTS

JP 2006-65178 3/2006

* cited by examiner

*Primary Examiner*—Marlon T Fletcher
(74) *Attorney, Agent, or Firm*—Morrison & Foerster LLP

(57) ABSTRACT

This system serves as one musical instrument by interconnecting a plurality of musical apparatuses EMa through EMf via an expandable communication connecting portion such as USB networks CB and UH. The respective musical apparatuses EMa through EMf have their own apparatus information. For the host musical apparatus EMa, a plurality of path rule information sets which are associated with a plurality of possible statuses where apparatuses are interconnected on a USB network and each of which specifies a path along which music data is transferred among the musical apparatuses are provided. Once the musical apparatuses EMb through EMf are connected to the USB network, the host musical apparatus EMa creates an actual connection pattern Pa1 representative of an actual apparatus connection status in accordance with the apparatus information of the apparatuses EMa through EMf. The host musical apparatus EMa then allows transfer of music data in accordance with a path rule information set selected on the basis of the actual connection pattern Pa1.

5 Claims, 6 Drawing Sheets

| apparatus number | apparatus type | pattern Pa1 |
|---|---|---|
| 1 | tone generating apparatus TG | 1 |
| 2 | keyboard apparatus KB | 1 |
| 3 | wheel apparatus WH | 0 |
| 4 | sequencer apparatus SQ | 1 |
| 5 | mixer apparatus MX | 1 |
| 6 | effector apparatus EF | 1 |
| 7 | speaker apparatus SP | 1 |
| 8 | foot controller FC | 0 |
| ⋮ | ⋮ | ⋮ |

| apparatus number | apparatus type | pattern Pa2 |
|---|---|---|
| 1 | tone generating apparatus TG | 1 |
| 2 | keyboard apparatus KB | 1 |
| 3 | wheel apparatus WH | 0 |
| ⋮ | ⋮ | ⋮ |

FIG.3

| index number | model connection pattern Pc | | | | | | | | | indication of each index |
|---|---|---|---|---|---|---|---|---|---|---|
| | TG | KB | WH | SQ | MX | EF | SP | FC | ··· | |
| Index 1 | 1 | 0 | 0 | 0 | 0 | 0 | 0 | 0 | ··· | reference information of path rule information set Rt1 |
| Index 2 | 1 | 1 | 0 | 0 | 0 | 0 | 0 | 0 | ··· | reference information of path rule information set Rt2 |
| Index 3 | 1 | 0 | 1 | 0 | 0 | 0 | 0 | 0 | ··· | reference information of path rule information set Rt3 |
| Index 4 | 1 | 1 | 1 | 0 | 0 | 0 | 0 | 0 | ··· | reference information of path rule information set Rt4 |
| ··· | ··· | ··· | ··· | ··· | ··· | ··· | ··· | ··· | ··· | ··· |
| Index i | 1 | 1 | 0 | 0 | 0 | 0 | 1 | 0 | ··· | reference information of path rule information set Rti |
| ··· | ··· | ··· | ··· | ··· | ··· | ··· | ··· | ··· | ··· | ··· |
| Index k | 1 | 1 | 0 | 1 | 1 | 1 | 1 | 0 | ··· | reference information of path rule information set Rtk |
| ··· | ··· | ··· | ··· | ··· | ··· | ··· | ··· | ··· | ··· | ··· |
| Index n | 1 | 1 | 1 | 1 | 1 | 1 | 1 | 1 | ··· | reference information of path rule information set Rtn |
| | 1 | 2 | 3 | 4 | 5 | 6 | 7 | 8 | ··· | ← corresponding At address |

FIG.4

(Index 1) path rule information Rt1:

[a] no transmission/reception (Index 2) path rule information Rt2:

[a] data of MIDI output terminal 1 of keyboard apparatus (KB) is transmitted to MIDI input terminal 1 of tone generating apparatus (TG)

⋮

(Index i) path rule information Rti:

[a] data of audio output terminal 1 of tone generating apparatus (TG) is transmitted to audio input terminal 1 of speaker apparatus (SP)

[b] data of MIDI output terminal 1 of keyboard apparatus (KB) is transmitted to MIDI input terminal 1 of tone generating apparatus (TG)

⋮

(Index k) path rule information Rtk:

[a]data of audio output terminal 1 of tone generating apparatus (TG) is transmitted to audio input terminal 1 of mixer apparatus (MX)
[b]data of MIDI output terminal 1 of keyboard apparatus (KB) is transmitted to MIDI input terminal 1 of tone generating apparatus (TG) and MIDI input terminal 1 of sequencer apparatus (SQ)
[c]data of MIDI output terminal 1 of sequencer apparatus (SQ) is transmitted to MIDI input terminal 2 of tone generating apparatus (TG)

[d]data of audio output terminal 1 of mixer apparatus (MX) is transmitted to audio input terminal 1 of speaker apparatus (SP)

[e]data of audio output terminal 2 of mixer apparatus (MX) is transmitted to audio input terminal 2 of speaker apparatus (SP)

[f]data of audio output terminal 3 of mixer apparatus (MX) is transmitted to audio input terminal 1 of effector apparatus (EF)

[g]data of audio output terminal 4 of effector apparatus (EF) is transmitted to audio input terminal 9 of mixer apparatus (MX)

⋮

ELECTRONIC MUSICAL INSTRUMENT SYSTEM AND PROGRAM THEREOF

BACKGROUND OF THE INVENTION

1. Field of the Invention

The present invention relates to an electronic musical instrument system which allows a plurality of desired musical apparatuses to interconnect via an expandable general purpose communications connecting portion to form a user's desired musical instrument as a whole.

2. Description of the Related Art

Recently, some electronic musical instruments are capable of connecting to a separate musical apparatus such as a tone generator via a communications cable in order to expand their music capability such as a tone generating capability to obtain user's desired music capability. For example, Japanese Patent Laid-Open Publication No. 2006-65178 discloses an art for establishing a communications path for the connection between an electronic musical instrument and an external tone generator via a communications connecting portion such as a USB (Universal Serial Bus).

SUMMARY OF THE INVENTION

A plurality of desired musical apparatuses can be interconnected to configure a user's desired musical instrument. In the conventional art, however, when the musical apparatuses are viewed as one musical instrument, transmission and reception of data are done only between two musical apparatuses which configures the musical instrument. More specifically, the conventional art does not expect to connect any more musical apparatuses to configure a user's desired musical instrument. In general, a plurality of desired musical apparatuses can be interconnected through MIDI, however, both physical connection and logical connection of musical apparatuses are difficult through MIDI.

The present invention was accomplished to solve the above-described problems, and an object thereof is to provide an electronic musical instrument system which enables easy customization and scalable expansion by interconnecting a plurality of desired musical apparatuses to configure a user's desired musical instrument.

In order to achieve the above-described object, a feature of the present invention is to provide an electronic musical instrument system serving as a musical instrument by interconnecting a plurality of musical apparatuses (EM: EMa, EMb, etc.) via an expandable communication-connecting portion (CB, UH), wherein each of the plurality of musical apparatuses (EM) interconnected via the communication connecting portion (CB, UH) has its apparatus information representative of a type of the musical apparatus, one-musical apparatus (EMa) of the musical apparatuses (EM) comprising a connection detecting portion (A2) for detecting respective connections with the other musical apparatuses (EMb, etc.) via the communication connecting portion (CB, UH); a connection status verifying portion (A2) for obtaining apparatus information from the respective musical apparatuses (EMa, EMb, etc.) whose interconnection has been detected by the connection detecting portion (A2), and verifying an actual connection status of the respective musical apparatuses (Pa: Pa1, Pa2); a rule obtaining portion (A4) for obtaining a plurality of path rule information sets (Rt: Rt1 through Rtn) provided in correspondence with a plurality of possible statuses in which the plurality of musical apparatuses are interconnected (Pc: Index 1 through n) via the communication connecting portion (CB, UH), the path rule information sets specifying paths ([a], [b], etc.) along which music data is transferred among the musical apparatuses (EM); a rule selecting portion (A3, A4) for selecting, from among the path rule information sets (Rt) obtained by the rule obtaining portion (A4), a path rule information set (Rt) corresponding to the actual musical apparatus connection status (Pa) verified by the connection status verifying portion (A2); and a data transferring portion (A10, A11; 8) for transferring music data in accordance with a path ([a], [b], etc.) specified by the path rule information set (Rt) selected by the rule selecting portion (A3, A4). Parenthesized reference symbols, terms and sections correspond to those described in an embodiment, respectively.

In this case, the communication connecting portion includes a USB cable and/or a USB hub, for example. Furthermore, the plurality of musical apparatuses are at least two or more apparatuses selected from among a tone generating apparatus (TG), a keyboard apparatus (KB), a sequencer apparatus (SQ), a mixer apparatus (MX), an effector apparatus (EF), a speaker apparatus (SP), a foot controller apparatus (FC), a wheel apparatus (WH), additional auxiliary operational apparatuses (AX), a recorder apparatus (RC), a display apparatus (DP) and a storage apparatus (ST), for example.

The present invention provides the electronic musical instrument system serving as a musical instrument by connecting the plurality of musical apparatuses (EM: EMa, EMb, etc.) to a network via the expandable communication connecting portion (CB, UH) such as a USB. Each of the musical apparatuses (EM) interconnected via the communication connecting portion (CB, UH) has apparatus information representative of the type of the musical apparatus. Of the musical apparatuses (EM), the musical apparatus (EMa) referred to as "host musical apparatus" is capable of obtaining (A4; 3, SV) a plurality of path rule information sets (Rt: Rt1 through Rtn) provided in correspondence with a plurality of possible statuses (Pc; Index 1 through n) in which the plurality of musical apparatuses are interconnected via the communication connecting portion (CB, UH). The path rule information sets (Rt) specify paths (logical connection: [a], [b], etc.) along which music data is transferred among the musical apparatuses (EM) in the respective statuses (Pc) in which the musical apparatuses are interconnected (FIG. 4).

In this electronic musical instrument system, if the other musical apparatuses (EMb, etc.) are interconnected via the communication connecting portion (CB, UH) (A2), the host musical apparatus (EMa) obtains apparatus information from the interconnected musical apparatuses (EMb, etc.), and verifies an actual status (Pa: Pa1, Pa2) in which the musical apparatuses are connected (A2). The host musical apparatus (EMa) then automatically selects, from among the path rule information sets (Rt), a path rule information set (Rt) corresponding to the actual status (Pa) in which the musical apparatuses are interconnected, and stores the selected path rule information set (Rt) (A4). Music data is then transferred along a path ([a], [b], etc.) specified in accordance with the path rule information set (Rt) (A10, A11; 8). In other words, the host musical apparatus (EMa) examines what apparatuses are actually connected to the network, and establishes an optimal logical connection in accordance with the examined actual status in which the apparatuses are connected to configure a desired electronic musical instrument system.

According to this invention, therefore, connection terminals of the musical apparatuses configuring the electronic musical instrument can be standardized to adopt the expandable communication connecting portion such as USB, simplifying physical connection among the musical apparatuses and allowing automatic establishment of logical connection and the like. As a result, this invention enables configuration of an electronic musical instrument system which allows easy customization and scalable expansion by interconnecting a plurality of desired musical apparatuses to configure user's desired musical instrument.

Another feature of the present invention is to provide the electronic musical instrument system wherein the actual connection status of the musical apparatuses (Pa) is represented by first connection information (FIG. 1C, FIG. 2B: "1", "0") indicating whether or not the respective musical apparatuses possibly connected via the communication connecting portion (CB, UH) are actually connected; the possible statuses in which the plurality of musical apparatuses are interconnected (Pc; Index 1 through n) are represented by second connection information (FIG. 3: "1", "0") indicating whether or not the respective musical apparatuses are interconnected; and the rule selecting portion (A4) selects a path rule information set (Rt) provided in correspondence with a musical apparatus connection status represented by the second connection information (Pc) which matches the first connection information (Pa).

According to the another feature of the present invention, previously provided possible statuses in which musical apparatuses are interconnected (Pc; Index 1 through n) are represented by patterns (model connection pattern Pc) using the second connection information (FIG. 3: "1", "0") indicating whether or not the respective musical apparatuses which are possibly interconnected via the communication connecting portion (CB, UH) are interconnected. According to the another feature, in addition, an actual status in which the musical apparatuses are connected (Pa) is represented by a pattern (actual connection pattern Pa) using the first connection information (FIG. 1C, FIG. 2B: "1", "0") indicating whether or not the respective musical apparatuses are actually connected. For the selection of a path rule information (Rt), the detected actual connection pattern (Pa) is compared with the previously provided model connection patterns (Pc) to select a path rule information set (Rt) provided in correspondence with a model connection pattern (Pc) which matches the actual connection pattern (Pa). Therefore, the present invention enables selection of a path rule information set which is the most suitable for an actual status in which the musical apparatuses are interconnected from among the previously provided path rule information sets, enabling establishment of an optimal logical connection.

In addition to the embodiment as the electronic musical instrument system, the present invention can be embodied as a computer program and a method applied to the electronic musical instrument system.

BRIEF DESCRIPTION OF THE DRAWINGS

FIG. 3 is a diagram showing a format of a configuration table used by the electronic musical instrument system;

FIG. 4 is a diagram showing an example of path rule information used by the electronic musical instrument system.

DESCRIPTION OF THE PREFERRED EMBODIMENT

Overview of Electronic Musical Instrument System

Figure 1A:
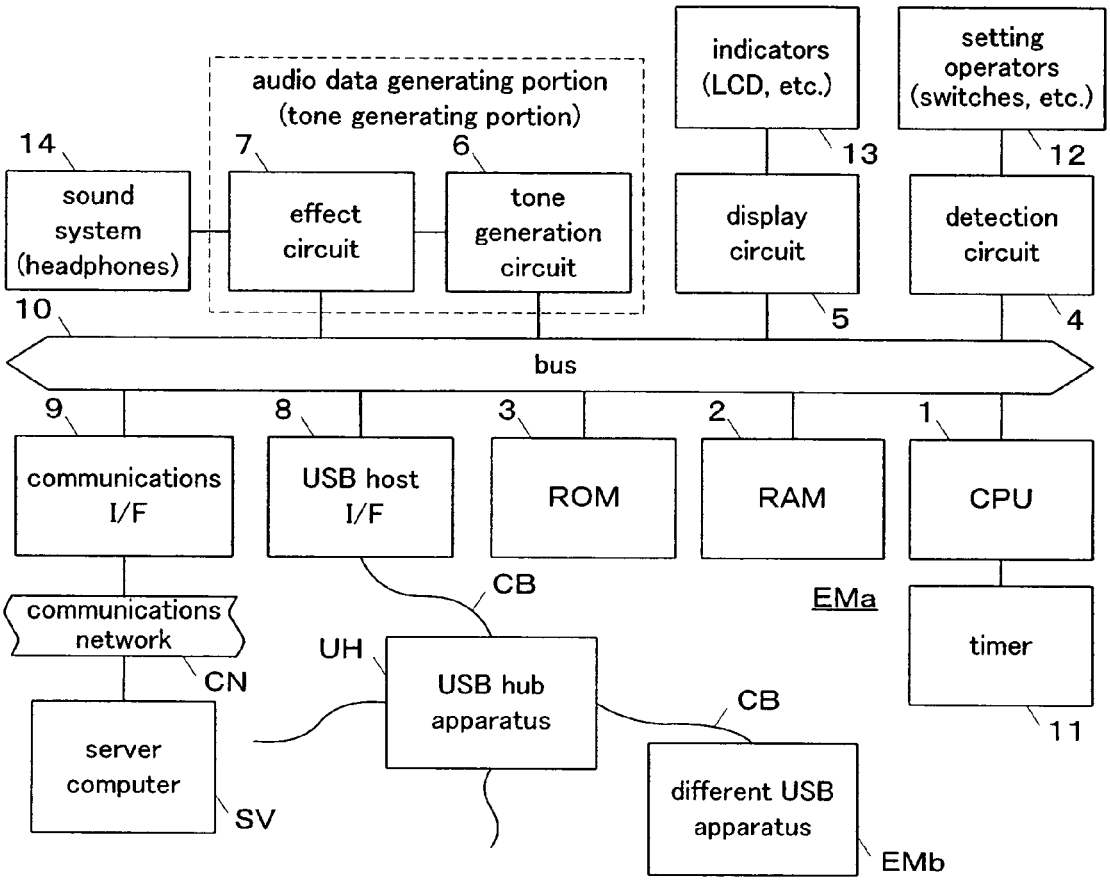
FIG. 1A is a block diagram showing a hardware configuration of a tone generating apparatus of an electronic musical instrument system of an embodiment of the present invention.
Figures 1B, 1C:
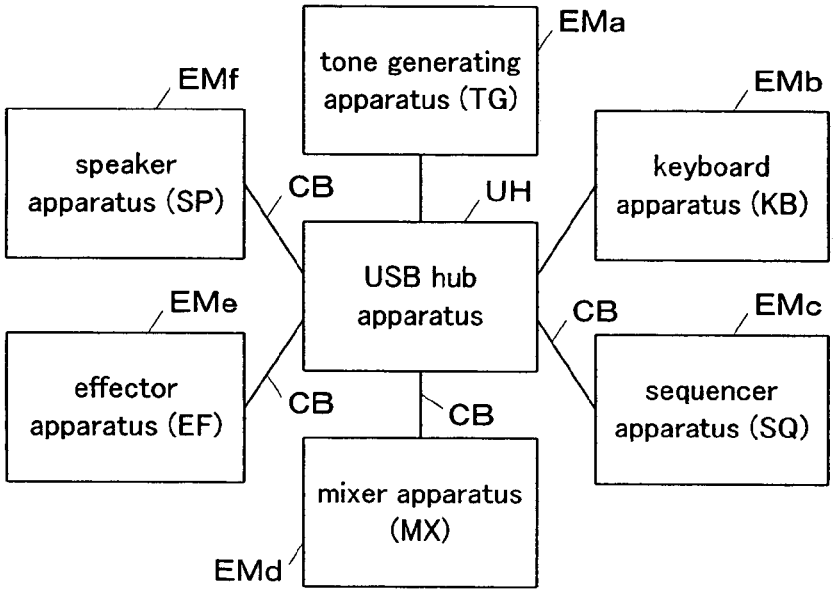
FIG. 1B is a block diagram showing an example configuration of the electronic musical instrument system.
FIG. 1C is a diagram showing a format of an apparatus table according to the example configuration, the apparatus table being provided for the tone generating apparatus.

In the electronic musical instrument system according to an embodiment of the present invention, a plurality of desired musical apparatuses (electronic musical apparatuses) including a tone generating apparatus (TG) are interconnected via an expandable communication connecting portion such as a USB to construct a musical instrument having desired electronic musical instrument capabilities. FIG. 1A and FIG. 1B are diagrams showing an overview of the electronic musical instrument system according to the embodiment of the present invention. FIG. 1A is a block diagram showing a hardware configuration of the tone generating apparatus. The tone generating apparatus (TG) EMa is a kind of computer having a capability of processing musical tone information on generation of musical tone signals and the like. The tone generating apparatus EMa includes a central processing unit (CPU) 1, a random-access memory (RAM) 2, a read-only memory (ROM) 3, a detection circuit 4, a display circuit 5, a tone generation circuit 6, an effect circuit 7, a USB host interface (I/F) 8, a communications interface (I/F) 9 and the like. These elements 1 through 9 are interconnected through a bus 10.

The CPU 1 functions, in conjunction with the RAM 2 and the ROM 3, as a data processing portion to execute, in accordance with a certain control program, certain musical tone information processing by use of a clock by a timer 11. The musical tone information processing includes establishment and control of paths along which music data is transferred, the establishment and control being referred to as host processing executed in conjunction with the USB host I/F 8. The RAM 2 is used as a working area for temporarily storing various kinds of data necessary for the processing. For the host processing, for instance, the RAM 2 provides an area for creating an apparatus table (At) and an area for establishing path rules (Rt). The ROM 3 previously stores various control programs for executing the processing and control data such as a configuration table (Ct) and path rule information (Rt). In the ROM 3, apparatus information indicating that the type of the musical apparatus EMa is a tone generating apparatus (TG) is described as a descriptor.

Through a communications network CN such as the Internet or a LAN, the communications I/F 9 is connected to a server computer SV and the like to allow the tone generating apparatus EMa to load control programs, control data and the like into the RAM 2.

The detection circuit 4 detects user's operations of setting operators 12 provided on an operating panel and delivers detected results to the data processing portion. The display circuit 5 controls display and illumination of a display unit such as an LCD and indicators 13 under the direction of the CPU 1 to provide a user with assistance in operating the operators 12 or to display what is played thereon. These elements 4, 5, 12 and 13 function as a user interface.

The tone generation circuit 6 generates audio data having waveforms corresponding to respective musical tones represented by performance data. To the audio data generated by the tone generation circuit 6, an effect is added on the basis of the performance data by the effect circuit 7 having an effect adding DSP. These circuits 6 and 7 function as an audio data generating portion (also referred to as tone generating portion). These circuits 6 and 7 may be configured by software. A sound system 14 connected to the effect circuit 7 includes a D/A converter, amplifiers and headphone speakers. The sound system 14 emits musical tones based on audio data delivered from the tone generating portion 6, 7.

The USB host I/F 8 functions as a virtual MIDI input terminal for inputting performance data from an external musical apparatus to the tone generating portion 6, 7. The USB host I/F 8 also functions as a virtual audio output terminal for outputting audio data delivered from the tone generating portion 6, 7 to an external musical apparatus. To the USB host I/F 8, a USB cable CB is connected to allow the tone generating apparatus (TG) EMa to connect with other USB compatible musical apparatuses through a USB network including the USB cable CB. The example shown in FIG. 1A configures a USB network in which the USB cables CB are connected to a USB hub apparatus UH which serves as a relay to form the shape of a star. More specifically, other USB compatible musical apparatuses EMb, etc. including a keyboard apparatus (KB) EMb which generates keyboard performance data on the basis of user's keyboard performance are connected to the tone generating apparatus (TG) EMa through the USB network. The tone generating apparatus EMa, which functions as a musical apparatus of the USB host, is referred to as "host apparatus" or "main body apparatus". The other musical apparatuses EMb, etc., which function as USB clients, are referred to as "client apparatuses" or "external apparatuses".

In other words, the tone generating apparatus (TG) EMa obtains, via the USB host I/F 8, apparatus information of the other musical apparatuses EMb, etc. connected to the tone generating apparatus (TG) through the USB network, so that the tone generating apparatus (TG) EMa can determine, on the basis of the obtained apparatus information, transfer destinations EMj to which music data is transferred from the respective musical apparatuses EMi: EMa, EMb, etc. If the USB host I/F 8 receives music data transmitted from a musical apparatus EMi, the USB host I/F 8 transfers the received music data to a musical apparatus EMj which is a transfer destination determined for the music data. If the USB host I/F 8 receives keyboard performance data from the keyboard apparatus (KB) EMb, for instance, the keyboard performance data is delivered to the virtual MIDI input terminal of the tone generating apparatus (TG) EMa. If the USB host I/F 8 receives audio data from the tone generating portion 6, 7, the audio data is delivered to the virtual audio output terminal of the tone generating apparatus (TG) EMa. As described above, the electronic musical instrument system allows transmission and reception of various kinds of music information among the plurality of musical apparatuses EMa, EMb, etc. to function as a musical instrument.

FIG. 1B shows an example configuration of the electronic musical instrument system. In the shown example configuration, not only the keyboard apparatus (KB) EMb but also a sequencer apparatus (SQ) EMc, a mixer apparatus (MX) EMd, an effector apparatus (EF) EMe and a speaker apparatus (powered speaker SP) EMf are connected with the tone generating apparatus (TG) EMa of the USB host through the USB cables CB and the USB hub apparatus UH. The sequencer apparatus (SQ) EMc generates sequencer performance data on the basis of keyboard performance data of the keyboard apparatus EMb or manipulation of the sequencer apparatus (SQ) EMc for inputting data. The mixer apparatus (MX) EMd mixes desired input audio data and outputs the mixed data to a desired audio processing apparatus. The effector apparatus (EF) EMe adds an effect to audio data delivered from the mixer apparatus EMd and transmits the effect-added audio data back to the mixer apparatus EMd. The speaker apparatus (powered speaker SP) EMf converts desired input audio data from digital signals to analog signals, amplifies the converted analog signals, and emits musical tones from speakers.

According to the example of FIG. 1B, for example, keyboard performance data of the keyboard apparatus EMb is output to the tone generating apparatus EMa and the sequencer apparatus EMc. Sequencer performance data of the sequencer apparatus EMc is output to the tone generating apparatus EMa. Audio data of the tone generating apparatus EMa and the effector apparatus EMe is output to the mixer apparatus EMd. Audio data of the mixer apparatus EMd is output to the effector apparatus EMe and the speaker apparatus EMf. Such data transmission and reception enable the electronic musical instrument system of FIG. 1B to serve as a musical instrument.

The musical apparatuses composing the electronic musical instrument system also include a foot controller (FC), a wheel apparatus (WH), an additional auxiliary operational apparatus (AX), a recorder apparatus (RC), a display apparatus (DP), a storage apparatus (ST), etc. The foot controller (FC) generates performance data and performance control data on the basis of performance operations of a pedal keyboard or the like. The wheel apparatus (WH) generates performance control data for independently controlling pitch, modulation and the like of performance data. The additional auxiliary operational apparatus (AX) independently serves as faders and switches for specifying conditions under which musical tones are emitted. The recorder apparatus (RC) stores various kinds of performance data in a certain storage medium such as CD. The display apparatus (DP) independently displays elements which relate to play of the electronic musical instrument system. The storage apparatus (ST) stores performance data. Similarly to the tone generating apparatus EMa, the respective musical apparatuses configuring the system have the data processing portion, the user interface and the USB I/F. In addition, the respective musical apparatuses are capable of performing music information processing specific to the respective apparatuses. The respective apparatuses also have apparatus information representative of their apparatus type as descriptor.

As described above, this electronic musical instrument system is configured by portions such as the USB apparatuses EMa, EMb, etc. each having its own apparatus information as descriptor. The tone generating apparatus EMa which is the host apparatus checks the physical connection to determine, on the basis of apparatus information obtained from the descriptor of the respective apparatuses connected to the USB network, what apparatuses reside on the network. The tone generating apparatus EMa then creates an apparatus table At in the RAM 2. The tone generating apparatus EMa then obtains a corresponding path rule information set Rt in accordance with the physical connection indicated by the apparatus table At. In accordance with the obtained path rule information set Rt, the tone generating apparatus EMa determines a logical connection indicative of a path of transmission and reception of music data among the respective apparatuses to configure an optimal musical instrument system which serves as a musical instrument.

The apparatus table At describes an actual status of the system in which musical apparatuses are interconnected. In the apparatus table At, more specifically, component apparatus numbers (also referred to simply as "apparatus number" or "apparatus table address") 1, 2, . . . , m are previously provided for the maximum number (m) of musical apparatuses which can be connected on the USB network to compose the musical instrument, component apparatus numbers corresponding to musical apparatuses. In order to describe an actual status of the system, furthermore, each component apparatus number is provided with connection information "1", "0". The apparatus table At is stored in the apparatus table creating area of the RAM 2. The connection information "1", "0" indicates whether a musical apparatus corresponding to a component apparatus number is actually connected on the USB network or not.

The respective component apparatus numbers are associated with the type of the musical apparatuses as shown in the middle column of the table of FIG. 1C; apparatus number 1: tone generating apparatus TG, apparatus number 2: keyboard apparatus KB, apparatus number 3: wheel apparatus WH, apparatus number 4: sequencer apparatus SQ, apparatus number 5: mixer apparatus MX, apparatus number 6: effector apparatus EF, apparatus number 7: speaker apparatus SP, apparatus number 8: foot controller, etc. The physical connection is checked to determine whether or not the respective musical apparatuses corresponding to the respective apparatus numbers reside on the USB network. As shown in the right column of the table, if a musical apparatus resides, the corresponding apparatus number is provided with the connection information of "1". If a musical apparatus does not reside, the corresponding apparatus number is provided with the connection information of "0". A data string composed of the connection information pieces is referred to as an actual connection pattern Pa.

In a case where the musical apparatuses are connected as the physical connection shown in FIG. 1B, for instance, the USB host apparatus EMa determines on the basis of its own descriptor and respective descriptors of the other interconnected USB apparatuses EMb through EMf that the tone generating apparatus TG, the keyboard apparatus KB, the sequencer apparatus SQ, the mixer apparatus MX, the effector apparatus EF and the speaker apparatus SP reside on the USB network. As shown in the apparatus table At shown in FIG. 1C, the apparatus numbers corresponding to these musical apparatuses are provided with the connection information of "1", while the other apparatus numbers are provided with the connection information of "0", resulting in an actual connection pattern Pa1="11011110 . . . ".

Figures 2A, 2B:
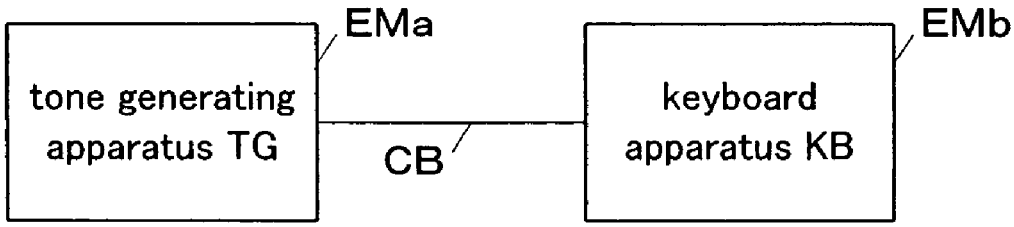
FIG. 2A is a block diagram showing another example configuration of the electronic musical instrument system.
FIG. 2B is a diagram showing a format of an apparatus table according to the another example configuration, the apparatus table being provided for the tone generating apparatus.

FIG. 2A shows an example of the simplest configuration as another example configuration of this electronic musical instrument system. As shown by the physical connection of FIG. 2A, in this example, only the keyboard apparatus (KB) EMb is connected to the USB host of the tone generating apparatus (TG) EMa through the USB cable CB. As shown in FIG. 2B, as a result, an apparatus table At having an actual connection pattern PA2="110 . . . " is provided as the physical connection of this example configuration.

The host musical apparatus EMa of this electronic musical instrument system is provided with the path rule information Rt for determining a logical connection corresponding to a physical connection of the musical apparatuses residing on the USB network. The path rule information Rt is obtained from the ROM 3 or the server computer SV. In order to obtain a path rule information set Rt corresponding to the actual connection pattern Pa: Pa1, Pa2 of the apparatus table At, in addition, the configuration table Ct is provided. The configuration table Ct defines the path rule information sets Rt by index number, the path rule information sets Rt being associated with model connection patterns Pc representative of respective statuses of various physical connections which can realize the electronic musical instrument system. The configuration table Ct can be also obtained from the ROM 3 or the server computer SV. FIG. 3 shows an example configuration table provided for the host musical apparatus. FIG. 4 shows example path rule information which is referred to on the basis of the index of the configuration table.

As shown in FIG. 3, the configuration table Ct is a table in which patterns Pc representative of all the possible combinations of the musical apparatuses which can be physically connected with the USB network to configure the electronic musical instrument system are associated with indexes (Index 1 through n), each of which is indicative of reference information of a path rule information set Rt. As described above, these patterns Pc are referred to as model connection patterns. In the model connection patterns Pc, similarly to the apparatus table At: At1, At2, the apparatus numbers of the musical apparatuses possibly connected to the USB network to configure the musical instrument are provided with the connection information. In the model connection patterns Pc, more specifically, the apparatus numbers of the musical apparatuses physically connected to the USB network are provided with the connection information of "1", while the apparatus numbers of the musical apparatuses which are not physically connected to the USB network are provided with the connection information of "0". Therefore, the model connection patterns Pc indicate that the musical apparatuses having the connection information of "1" are interconnected in accordance with a specified combination.

Index 3 corresponds to the model connection pattern Pc="1010 . . . " in which only the tone generating apparatus TG and the wheel apparatus WH are connected to the USB network. Since there is no possibility that only the performance control-data of the wheel apparatus WH is transmitted to the tone generating apparatus TG, Index 3 can be eliminated. In other words, impossible physical connections can be eliminated from the configuration table Ct to reduce data amount of the table.

As shown in the right column of FIG. 3, each index (Index 1 through n) corresponding to a model connection pattern Pc indicates a path rule information set Rt which is referred to for the status of the physical connection of the musical apparatuses represented by the corresponding model connection pattern Pc. As shown in FIG. 4, the path rule information sets Rt are information which specifies data paths, being associated with respective possible connection statuses of the musical apparatuses, that is, the path rule information sets Rt are associated with the respective indexes (Index 1 through n) of the configuration table Ct. More specifically, the path rule information sets Rt specify respective optimal paths along which music data is transferred when the electronic musical instrument system is configured in accordance with the respective connection statuses of the musical apparatuses corresponding to the respective indexes.

In a case where the musical apparatuses EMb, . . . are connected to the host musical apparatus EMa, as described above, the host musical apparatus EMa creates the apparatus table At: At1, At2 on the basis of the apparatus information obtained from the interconnected musical apparatuses EMa, EMb, . . . and then obtains the actual connection pattern Pa: Pa1, Pa2 representative of the actual physical connection. The host musical apparatus EMa is then capable of defining an optimal logical connection by use of the configuration table Ct and the path rule information Rt. In this case, the host musical apparatus EMa searches the configuration table Ct based on the obtained actual connection pattern Pa1 for the model connection pattern Pc corresponding to the actual connection pattern Pa1. In accordance with a path rule information set Rt specified by an index corresponding to the found model connection pattern Pc, an optimal logical connection corresponding to the actual connection status is determined. The electronic musical instrument system allows the musical apparatuses to transfer music data along a path of the logical connection until the physical connection is actually changed.

For the search of the configuration table Ct based on the actual connection pattern Pa, it is preferable to use pattern matching of the actual connection pattern Pa and the model connection pattern Pc. If there is no model connection pattern Pc which exactly matches the actual connection pattern Pa, the host musical apparatus EMa adopts, as the model connection pattern Pc, a model connection pattern Pc whose connection information pieces indicative of "1" include all the connection information pieces indicative of "1" of the actual connection pattern Pa and also contain the least number of connection information pieces indicative of "1" which do not match with the actual connection pattern Pa. This adoption scheme minimizes unnecessary path information.

A concrete example of the configuration table Ct and the path rule information Rt will now be described. In the configuration table Ct shown in FIG. 3, for example, Index 1 corresponds to the model connection pattern Pc="100 . . . " where only the tone generating apparatus TG is connected to the USB network. This pattern refers to the path rule information Rt 1 shown in FIG. 4 (Index 1), so that the tone generating apparatus TG will not transmit or receive any music data. Index 2, which corresponds to the example system configuration shown in FIG. 2A where the tone generating apparatus TG and the keyboard apparatus KB are connected to the USB network, is the model connection pattern Pc="110 . . . "=actual connection pattern Pa2. This pattern refers to path rule information Rt2 shown in Index 2 of FIG. 4 to instruct the keyboard apparatus KB to transmit keyboard performance data delivered from a virtual MIDI output terminal 1 of the keyboard apparatus KB to a virtual MIDI input terminal 1 of the tone generating apparatus TG [a]. The MIDI/audio input/output terminals described here are not physical terminals but virtual terminals realized by USB terminals.

Index "i" shown in FIG. 3 corresponds to a pattern where the tone generating apparatus TG, the keyboard apparatus KB and the speaker apparatus SP are connected to the USB network. This pattern refers to path rule information Rti shown in FIG. 4 (Index "i") to instruct the tone generating apparatus TG to transmit audio data delivered from audio output terminal 1 of the tone generating apparatus TG to a virtual audio input terminal 1 of the speaker apparatus SP [a], and to instruct the keyboard apparatus KB to transmit keyboard performance data delivered from the virtual MIDI output terminal 1 of the keyboard apparatus KB to the virtual MIDI input terminal 1 of the tone generating apparatus TG [b].

Index "k" of FIG. 3, which corresponds to the example system configuration shown in FIG. 1B where the tone generating apparatus TG, the keyboard apparatus KB, the sequencer apparatus SQ, the mixer apparatus MX, the effector apparatus EF and the speaker apparatus SP are connected to the USB network, is the model connection pattern Pc="11011110 . . . "=actual connection pattern Pa1. This pattern refers to path rule information Rtk shown in Index "k" of FIG. 4 to instruct a logical connection shown by following paths [a] through [g].

[a] transmit audio data delivered from the virtual audio output terminal 1 of the tone generating apparatus TG to a virtual audio input terminal 1 of the mixer apparatus MX

[b] transmit data delivered from the virtual MIDI output terminal 1 of the keyboard apparatus KB to the virtual MIDI input terminal 1 of the tone generating apparatus TG and a virtual MIDI input terminal 1 of the sequencer apparatus SQ

[c] transmit sequencer performance data delivered from a virtual MIDI output terminal 1 of the sequencer apparatus SQ to a virtual MIDI input terminal 2 of the tone generating apparatus TG

[d] transmit audio data delivered from a virtual audio output terminal 1 of the mixer apparatus MX to the virtual audio input terminal 1 of the speaker apparatus SP

[e] transmit audio data delivered from a virtual audio output terminal 2 of the mixer apparatus MX to a virtual audio input terminal 2 of the speaker apparatus SP

[f] transmit audio data delivered from a virtual audio output terminal 3 of the mixer apparatus MX to a virtual audio input terminal 1 of the effector apparatus EF

[g] transmit audio data delivered from a virtual audio output terminal 4 of the effector apparatus EF to a virtual audio input terminal 9 of the mixer apparatus MX Characteristics of the electronic musical instrument system according to the embodiment of the present invention will be briefly described, referring to the example configuration shown in FIG. 1B. This electronic musical instrument system serves as a musical instrument by interconnecting the plurality of musical apparatuses EMa through EMf via the expandable communication connecting portion such as the USB network CB, UH. The respective musical apparatuses EMa through EMf have apparatus information representative of the type of their own musical apparatus. Among these musical apparatuses EMa through EMf, the musical apparatus EMa referred to as "host musical apparatus" is provided with the "configuration table Ct" for searching for a logical connection and the plurality of "path rule information sets Rt: Rt1 through Rtn". In the configuration table Ct, a plurality of possible connections of the musical apparatuses which can be realized on the USB network are represented as the model connection patterns Pc. The "configuration table Ct" for the search for logical connection indicates path rule information sets Rt1 through Rtn corresponding to connection statuses of the musical apparatuses with index (Index 1 through n). Each of the plurality of "path rule information sets Rt: Rt1 through Rtn" specifies a path (logical connection) along which music data is transferred among the musical apparatuses in a connection status of the respective musical apparatuses. If the host musical apparatus EMa detects the connection with the other musical apparatuses EMb through EMf via the communication connecting portion CB, UH, the host musical apparatus EMa retrieves apparatus information from the interconnected musical apparatuses EMa through EMf, verifies an actual connection status (physical connection) of the respective apparatuses on the basis of the retrieved apparatus information, and then creates the apparatus table At1 in which the connection status of the musical apparatuses is represented as the actual connection pattern Pa1. The host musical apparatus EMa then searches the configuration table Ct for an index (Index "k") having a model connection pattern Pc which matches the actual connection pattern Pa1. The host musical apparatus EMa then selects the path rule information set Rtk specified by the found index (Index "k") from among the path rule information sets Rt1 through Rtn (FIG. 4), to allow transfer of music data in accordance with the optimal path indicated by the path rule information Rtk.

Example Process Flow

Figure 5:
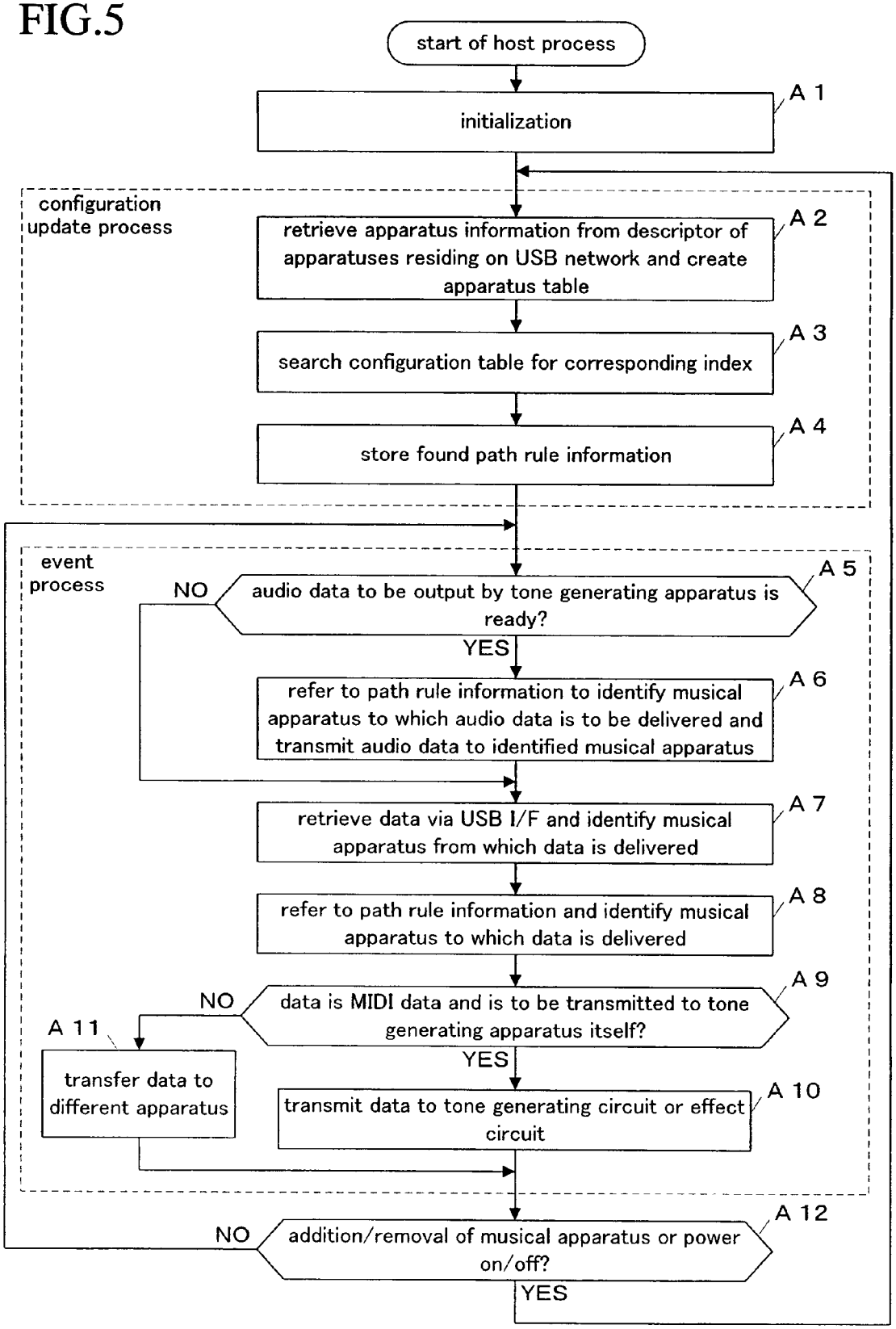
FIG. 5 is a flowchart showing a host process program of the tone generating apparatus (USB host).

FIG. 5 is a flowchart showing a host process program executed by the host musical apparatus in the electronic musical instrument system according to the embodiment of the present invention. In this electronic musical instrument system, if the host process program is started by the host musical apparatus, for example, the tone generating apparatus TG (EMa), the CPU 1 performs initialization at step A1 to clear various setting statuses on the host process. The CPU 1 then proceeds to steps A2 through A4 to perform an apparatus configuration update process. In the apparatus configuration update process (A2 through A4), the CPU 1 detects physical connection of the musical apparatuses residing on the USB network, determines a logical connection in accordance with the detected physical connection status, and then updates the apparatus configuration of the system. In order to determine a logical connection, the CPU 1 uses the path rule information Rt previously stored in the ROM 3 or loads the path rule information Rt from the server computer SV into the RAM 2 to use the loaded path rule information Rt. After the apparatus configuration update process, the CPU 1 proceeds to an event process of steps A5 through A1.

In the apparatus configuration update process, at step A2, the CPU 1 retrieves, the apparatus information from the descriptor of the respective musical apparatuses which currently configures the USB network, and verifies actual connection status of the apparatuses on the basis of the retrieved apparatus information. On the basis of the retrieved apparatus information, more specifically, the CPU 1 creates the apparatus table At indicative of the musical apparatuses which are connected to the USB network. At the following step A3, the CPU 1 searches the configuration table Ct in which various physical connection patterns on the USB network are associated with indexes for an index corresponding to an actual physical connection pattern indicated by the created apparatus table At. At step A4, the CPU 1 selects, from among the path rule information sets Rt obtained from the ROM 3 or the server computer SV, a path rule information set Rt indicated by the index obtained by the search at step A3 and stores the selected path rule information set Rt in the path rule setting area of the RAM 2.

In the following event process (A5 through A11), the CPU 1 determines at step A5 whether audio data has been ready to be output by the tone generating apparatus TG or not. If it is determined that the audio data has been ready (A5□ YES), the CPU 1 proceeds to step A6 to refer to the path rule information set Rt stored in the RAM 2 to identify musical apparatus to which the audio data is to be delivered. At step A6, the CPU 1 then transmits the audio data to the identified musical apparatus via the USB host I/F 8.

If audio data has not been ready to be output by the tone generating apparatus TG (A5□ NO), or if the process for transmitting the audio data (A6) has been carried out, at step A7 the CPU 1 retrieves music data from a different musical apparatus via the USB host I/F 8 and identifies a musical apparatus from which the music data has been transmitted on the basis of apparatus information which has been transmitted along with the music data. At step A8, the CPU 1 then refers to the path rule information set Rt stored in the RAM 2 to identify a musical apparatus to which the music data retrieved at step A7 is to be delivered. The CPU 1 then determines at step A9 whether the music data retrieved at step A7 is MIDI data (performance data or performance control data) to be transmitted to the tone generating apparatus TG itself.

If it is determined that the music data is MIDI data to be transmitted to the tone generating apparatus TG itself (A9□ YES), the CPU 1 transmits the music data (MIDI data to be transmitted to the tone generating apparatus TG) obtained at step A7 to the tone generating circuit 6 or the effect circuit 7 identified at step A8. If not (A9□ NO), the CPU 1 transfers the music data obtained at step A7 to the musical apparatus identified at step A8 via the USB host I/F 8. After either of steps A10 and A11, the CPU 1 proceeds to step A12. In a case where the CPU 1 does not retrieve music data from a different musical apparatus at step A7, the CPU 1 omits steps A7 through A11 to directly proceed to step A12.

At step A12, the CPU 1 determines whether the user has added or removed any musical apparatus to/from the USB network which currently configures the electronic musical instrument system, or the user has turned on/off the power of the musical apparatuses. More specifically, if any of the musical apparatuses which are currently capable of communicating each other on the USB network has been removed from the USB network, if the power of such musical apparatuses has been turned off, if another musical apparatus has been added to the USB network, or if the power of a musical apparatus connected to the USB network with its power being off has been turned on to make the musical apparatus communicate with other musical apparatuses on the USB network, the USB host I/F of the tone generating apparatus TG which is the host musical apparatus detects the change and determines that the apparatus configuration of the electronic musical instrument system has been changed. If it is determined at step A12 that there has been no addition/removal of any musical apparatus or no power-on/off (A12□ NO), therefore, the CPU 1 returns to step A5 to repeat the event process of steps A5 through A11 in accordance with the path rule information set Rt stored in the RAM 2 as far as there is no change in the apparatus configuration of the system.

If it is determined at step A12 that there has been an addition/removal of a musical apparatus or power-on/off (A12□ YES), the CPU 1 returns to step A2 to carry out the apparatus configuration update process of steps A2 through A4 and stores, in the RAM2, a path rule information set Rt selected on the basis of the changed apparatus configuration of the electronic musical instrument system. The CPU 1 then carries out the event process of steps A5 through A11.

VARIOUS EMBODIMENTS

The preferred embodiment of the present invention has been described, referring to the drawings, however, this embodiment is a mere example. The present invention can be variously modified without departing from the spirit and scope of the invention. For instance, the embodiment employs a dedicated tone generating apparatus TG as the host musical apparatus, however, a personal computer having a USB terminal and capable of running an audio data generation application including software tone generator may be adopted.

The determination of a path rule (Rt) may be performed by the server computer SV via the general-purpose communications network CN. In addition, a path rule (Rt) automatically defined in accordance with an actual physical connection pattern may be edited by the user.

What is claimed is:

1. An electronic musical instrument system serving as a musical instrument by interconnecting a plurality of musical apparatuses via an expandable communication connecting portion, wherein each of the plurality of musical apparatuses interconnected via the communication connecting portion has its apparatus information representative of a type of the musical apparatus, one musical apparatus of the musical apparatuses comprising:

a connection detecting portion for detecting respective connections with the other musical apparatuses via the communication connecting portion;

a connection status verifying portion for obtaining apparatus information from the respective musical apparatuses whose interconnection has been detected by the connection detecting portion, and verifying an actual connection status of the respective musical apparatuses;

a rule obtaining portion for obtaining a plurality of path rule information sets provided in correspondence with a plurality of possible statuses in which the plurality of musical apparatuses are interconnected via the communication connecting portion, the path rule information sets specifying paths along which music data is transferred among the musical apparatuses;

a rule selecting portion for selecting, from among the path rule information sets obtained by the rule obtaining portion, a path rule information set corresponding to the actual musical apparatus connection status verified by the connection status verifying portion; and a data transferring portion for transferring music data in accordance with a path specified by the path rule information set selected by the rule selecting portion, wherein the actual connection status of the musical apparatuses is represented by first connection information indicating whether or not the respective musical apparatuses possibly connected via the communication connecting portion are actually connected;

the possible statuses in which the plurality of musical apparatuses are interconnected are represented by second connection information indicating whether or not the respective musical apparatuses are interconnected; and the rule selecting portion selects a path rule information set provided in correspondence with a musical apparatus connection status represented by the second connection information which matches the first connection information.

2. An electronic musical instrument system according to claim 1, wherein the communication connecting portion includes a USB cable.

3. An electronic musical instrument system according to claim 1, wherein the communication connecting portion includes a USB hub.

4. An electronic musical instrument system according to claim 1, wherein the plurality of musical apparatuses are at least two or more apparatuses selected from among a tone generating apparatus, a keyboard apparatus, a sequencer apparatus, a mixer apparatus, an effector apparatus, a speaker apparatus, a foot controller apparatus, a wheel apparatus, a recorder apparatus, a display apparatus and a storage apparatus.

5. A computer-readable medium storing a program for an electronic musical instrument system serving as a musical instrument by interconnecting, via an expandable communication connecting portion, a plurality of musical apparatuses each having apparatus information representative of a type of its musical apparatus, the program causing a computer to execute the steps of:

a connection detecting step of detecting respective connections with the other musical apparatuses via the communication connecting portion;

a connection status verifying step of obtaining apparatus information from the respective musical apparatuses whose interconnection has been detected at the connection detecting step, and verifying an actual connection status of the respective musical apparatuses wherein the actual connection status of the musical apparatuses is represented by first connection information indicating whether or not the respective musical apparatuses possibly connected via the communication connecting portion are actually connected;

a rule obtaining step of obtaining a plurality of path rule information sets provided in correspondence with a plurality of possible statuses in which the plurality of musical apparatuses are interconnected via the communication connecting portion, the path rule information sets specifying paths along which music data is transferred among the musical apparatuses wherein the possible statuses in which the plurality of musical apparatuses are interconnected are represented by second connection information indicating whether or not the respective musical apparatuses are interconnected;

a rule selecting step of selecting, from among the path rule information sets obtained at the rule obtaining step, a path rule information set corresponding to the actual musical apparatus connection status verified at the connection status verifying step wherein the rule selecting step selects a path rule information set provided in correspondence with a musical apparatus connection status represented by the second connection information which matches the first connection information; and a data transferring step of transferring music data in accordance with a path specified by the path rule information set selected at the rule selecting step.

* * * * *